US006562148B1

(12) United States Patent
Wendel et al.

(10) Patent No.: US 6,562,148 B1
(45) Date of Patent: May 13, 2003

(54) PRETREATMENT OF ALUMINUM SURFACES WITH CHROME-FREE SOLUTIONS

(75) Inventors: Thomas Wendel, Schwalbach (DE); Klaus Bittner, Frankfurt am Main (DE); Hardy Wietzoreck, Frankfurt am Main (DE); Peter Müller, Baldham (DE)

(73) Assignees: Chemetall GmbH, Frankfurt am Main (DE); Bayerische Motorenwerke AG, Petuelring (DE)

( * ) Notice: Subject to any disclaimer, the term of this patent is extended or adjusted under 35 U.S.C. 154(b) by 0 days.

(21) Appl. No.: 10/018,165

(22) PCT Filed: Apr. 29, 2000

(86) PCT No.: PCT/EP00/03900

§ 371 (c)(1),
(2), (4) Date: Jan. 23, 2002

(87) PCT Pub. No.: WO00/68458

PCT Pub. Date: Nov. 16, 2000

(30) Foreign Application Priority Data

May 11, 1999 (DE) ..... 199 21 842

(51) Int. Cl.[7] ..... C23C 22/48

(52) U.S. Cl. ..... 148/247; 148/254; 148/275; 148/279; 427/309; 427/329

(58) Field of Search ..... 148/247, 254, 148/275, 279; 427/309, 329

(56) References Cited

U.S. PATENT DOCUMENTS

| | | | | |
|---|---|---|---|---|
| 4,148,670 A | | 4/1979 | Kelly | |
| 4,339,310 A | | 7/1982 | Oda et al. | |
| 5,026,440 A | * | 6/1991 | Finnenthal et al. | 148/247 |
| 5,584,946 A | * | 12/1996 | Karmaschek et al. | 148/247 |
| 5,801,217 A | | 9/1998 | Murphy et al. | |

FOREIGN PATENT DOCUMENTS

| | | |
|---|---|---|
| DE | 44 12 138 | 10/1995 |
| EP | 0 153 973 | 9/1985 |
| WO | 95 02077 | 1/1995 |
| WO | 95 14539 | 6/1995 |
| WO | 95 33869 | 12/1995 |
| WO | 97 04145 | 2/1997 |

OTHER PUBLICATIONS

Chemical Abstracts. vol. 90, No. 26, Jun. 25, 1979 & JP 54 024232 Feb. 23, 1979.

* cited by examiner

*Primary Examiner*—John Sheehan
*Assistant Examiner*—Andrew L. Oltmans
(74) *Attorney, Agent, or Firm*—Fulbright & Jaworski L.L.P.

(57) ABSTRACT

In a method for the pretreatment of work pieces having a surface made of aluminium or aluminium alloys, for non-cutting shaping and/or the connection by welding or gluing to work pieces as well as for a subsequent permanent corrosion-preventing treatment, the work pieces are subjected to a three-stage treatment by a) rinsing with an aqueous, acidic solution containing a mineral acid, b) rinsing with water, c) bringing them into contact with an aqueous, acidic solution which is chromium-free and polymer-free and contains Ti and Zr as complex fluorides in a weight ratio of Ti:Zr of 2:1 to 1:2, in such a way that, after the subsequent drying off, a layer weight of 2 to 15 $mg/m^2$ (calculated as Ti/Zr metal) results, wherein depending on the type of application, solutions having different concentrations and different pH values are used.

10 Claims, No Drawings

PRETREATMENT OF ALUMINUM SURFACES WITH CHROME-FREE SOLUTIONS

DESCRIPTION

The invention relates to a method for the pretreatment of work pieces having a surface made of aluminium or aluminium alloys, for non-cutting shaping and/or the connection by welding or gluing to work pieces which have been pretreated in the same way or pre-coated in another way if appropriate, or to portions made of steel and/or zinc-coated and/or zinc-alloy-coated steel that have been pretreated if appropriate, as well as for a subsequent corrosion-preventing treatment by phosphating, by a chromium-free conversion treatment, by application of primer or by varnishing.

For the chemical surface treatment of metals, for example in preparation for the application of varnishes, glues and plastics, methods are known in which the metal surface is cleaned in the first stage, rinsed with water in the second stage and finally, in the third stage, wetted with an aqueous solution which forms chemical conversion coatings, the liquid film being dried off. As a result of this, there is formed on the metal a thin, non-metallic coating which, in the case of an appropriately selected composition of the treatment liquid and the reaction conditions, can decisively improve the surface quality. Thus, for example, coatings made of varnishes, glues and plastics, if appropriate in the form of foils, can be distinguished by a substantially greater adhesion and a considerably increased protection against corrosion when they are applied to metal which has been pretreated in this way.

Methods of the above-mentioned type work, for example, with an aqueous solution which contains hexavalent chromium, trivalent chromium, alkali ions and silicon dioxide in certain proportions and generates coatings for the electrical insulation, for the corrosion protection and as a wash primer for varnishes and suchlike (DE-AS 17 69 582).

As a result of the presence of hexavalent chromium, these methods have in common the disadvantage that, in particular, precautions are required when applying the coating agent and handling the coated metal.

In order to avoid the disadvantages linked with the use of solutions which contain hexavalent chromium, another category of method for the application of conversion coatings, especially for aluminium surfaces, provides a treatment with compositions based on fluoro-anions of zirconium and/or titanium (U.S. Pat. No. 4,146,670, FR-A-942 789, EP-A-106 389, EP-A-825 280).

Recently, the use of work pieces having surfaces made of aluminium or aluminium alloys has taken on increasing importance in the construction of vehicles. Fundamental reasons for this are the reduction in the vehicle weight, but also the favourable ability of such work pieces to be recycled. In this connection, it is generally usual to make vehicles up from a plurality of portions, which have, as a rule, been shaped beforehand in a non-cutting manner and consist of work pieces having surfaces made of aluminium or aluminium alloys, but also having surfaces made of steel and/or zinc-coated steel and/or zinc-alloy-coated steel. By far the most important forms of connection or joining are welding or gluing.

A corrosion-preventing treatment, which, depending on the nature of the connected portions, can consist of a phosphating treatment, a chromium-free conversion treatment, an application of primer or a varnishing, usually follows the connection of the portions.

In order that a perfect connection of the portions having surfaces made of aluminium or aluminium alloys to each other or to portions made of steel and/or zinc-coated or zinc-alloy-coated steel is guaranteed, it is necessary to ensure that the surfaces of the aluminium or aluminium alloy are free from aluminium oxide or oxides of any alloying constituents of the aluminium that may be present. A pickling treatment which presents itself for this purpose does not achieve the objective, because the aluminium surface becomes coated with a new oxide layer after a very short time.

In order to solve the problem outlined above, the method of EP-B-700 452 provides that, for pretreatment, surfaces made of aluminium or its alloys are, before a second permanent corrosion-preventing treatment, brought into contact with an aqueous solution which contains complex fluorides of the elements boron, silicon, titanium, zirconium or hafnium individually or in a mixture with each other in concentrations of the fluoro-anions of 100 to 4000 mg/l in total and has a pH-value of 0.3 to 3.5. Between the pretreatment and the permanent corrosion-preventing conversion treatment, the portions made of aluminium or its alloys are subjected to a non-cutting and/or cutting shaping process and/or are connected to each other or to portions made of steel and/or zinc-coated and/or zinc-alloy coated steel by gluing and/or welding. The application of the solution, which contains polymers of a certain nature if appropriate, can take place by spraying, immersion or with the no-rinse method, in which case, in the case of the no-rinse method, the wet-film amount is to be between 2 and 10, preferably between 4 and 6 ml/m$^2$ metal surface. Regardless of the way in which the solution is applied, it is advantageous to dry at temperatures between 40 and 85° C. For the purpose of cleaning, the portions made of aluminium or its alloys are, before the first conversion treatment, cleaned in an acidic or alkaline environment; preferably, further cleaning steps and intermediate rinsings with water and/or with activating rinsing baths take place before the permanent corrosion-preventing treatment.

From the particulars of the concentrations of fluoro-anions in the solutions to be applied on the one hand and the wet-film amount on the other hand, there results, for the case of the application of a solution containing a fluoro-titanate, a layer of 0.06 to 11730 mg/m$^2$, preferably 0.12 to 7.04 mg/m$^2$ (in each case given as titanium metal), and, for the case of the application of a solution containing a fluoro-zirconate, a layer of 0.09 to 17780 mg/m$^2$, preferably 0.18 to 7.04 mg/m$^2$ (in each case given as zirconium metal).

The tests which preceded the conception of the present invention have shown that a plurality of the development possibilities described in EP-B-700 452 do not lead to many advantageous results, in particular with respect to the temporary corrosion protection achieved with the first chemical conversion treatment and the volume resistance which is important for the production of weld joints.

The object of the invention is to make available a method for the pretreatment of work pieces having a surface made of aluminium or aluminium alloys, for non-cutting shaping and/or the connection by welding or gluing to work pieces which have been pretreated in the same way or pre-coated in another way if appropriate, or to portions made of steel and/or zinc-coated and/or zinc-alloy-coated steel and also a subsequent permanent corrosion-preventing treatment by phosphating, by a chromium-free conversion treatment, by application of primer or by varnishing, which method regularly leads to work pieces having a sufficiently low volume resistance and at the same time good adhesion shear-tension values and good temporary corrosion-protection values.

The object is achieved as a result of the fact that the method of the type mentioned in the introduction is developed in accordance with the invention in such a way that the work pieces are a) pickled with an aqueous, acidic solution containing a mineral acid, by immersion or spraying, b) rinsed with water, c) brought into contact with an aqueous, acidic solution which is chromium-free and polymer-free and contains Ti and Zr as complex fluorides in a weight ratio of Ti:Zr of 2:1 to 1:2, in such a way that, after the subsequent drying off, a layer weight of 2 to 15 mg/m$^2$ (calculated as Ti/Zr metal) results, wherein, when solutions are brought into contact with the work piece, solutions are used which contain 300 to 700 mg/l fluoride (calculated as fluoro-anion) and have a pH-value of 4.0 to 5.0 in the case of application by immersion or spraying, and contain 5000 to 15000 mg/l fluoride (calculated as fluoro-anions) and have a pH-value of 1.0 to 3.0 in the case of application by the roller-application method.

It has emerged that neither in the case of the application of solutions which contain only fluoro-titanate or only fluoro-zirconate, nor in the case of the application of solutions in which the weight ratio of titanium:zirconium lies outside the weight ratio of 2:1 to 1:2, nor in the case of the application of solutions which lead to layer weights of titanium/zirconium outside the range of 2 to 15 mg/m$^2$ (calculated as titanium/zirconium metal) are results achieved which are satisfactory in terms of the object which is set. With respect to the layer weight which is to be set, it is therefore of decisive importance that, depending on the type of application, solutions which are made differently in terms of the concentration of the fluoro-anions and the pH-value are used.

In order to achieve the target pursued with the invention, it is furthermore important that the work pieces are pickled with an aqueous, acidic solution containing a mineral acid, by immersion or spraying. An alkaline cleaning results, for example, in the development of titanium/zirconium layers with poor volume resistance values. The same applies to layers which are obtained by using polymer-containing solutions, for which reason the solutions to be used in the method in accordance with the invention must be polymer-free.

The work pieces pretreated in accordance with the invention can be connected to work pieces which have been pretreated in the same way or pre-coated in another way if appropriate, for example phosphated, and which have surfaces made of aluminium or alloys thereof. If a connection to portions made of steel and/or zinc-coated and/or zinc-alloy-coated steel is intended, these portions can have bare or pre-coated surfaces. A suitable pre-coating can, for example, be a phosphate coating with a layer weight of a maximum of 2 g/m$^2$, or a layer of a conductive primer.

If the work pieces are oiled, a cleaning/degreasing stage is to precede the pickling method, or the pickling method is to be carried out in such a way that a simultaneous cleaning/degreasing takes place. The latter can take place by adding surfactant to the pickling solution.

As methods for the phosphating treatment, those which work with solutions based on zinc phosphate, in particular in accordance with low-zinc technology, or with alkali phosphate are to be given priority. The solutions can be modified by addition of further small amounts of polyvalent cations, such as calcium, magnesium, nickel, copper or manganese.

For the chromium-free conversion treatment, acidic solutions of the fluoro complexes of titanium, zirconium, hafnium in particular, but also boron and silicon, if appropriate with a content of organic polymer, are used.

So-called reaction primers or wash primers can be applied as the primer.

The pretreatment in accordance with the invention of the wore pieces ensures a sufficient, temporary corrosion protection for comparatively long storage times. During this time, no negative influencing of the weldability, in particular of the electric resistance welding, or of the bonding properties takes place. With respect to the weldability, it is also ensured that the volume resistance is practically the same in all surface regions of the work piece.

Strip, sheet metal and individual portions, such as profiles, are work pieces in the sense of the present invention.

The application of the solution in accordance with stage c) can take place by spraying or immersion, in each case with or without rinsing with water. In the case of an application without rinsing with water, it is advantageous to remove excess treatment solution with squeegee rollers, In the case of the treatment of sheet metal or strip, the application of the treatment solution according to the roll-coater method is particularly advantageous. It allows a defined adjustment of the desired wet-film thickness in one operation.

After the ways of applying the solution that are described above, the work piece is dried, or the solution is dried off. object temperatures of 30 to 90° C. are particularly advantageous.

For the preparation of the treatment liquids, concentrates are generally used, which are diluted with low-salt water, preferably deionized water, to the concentrations to be set in each case. In order to avoid the introduction of alkali ions, it is particularly advantageous to introduce the required fluoro-anions of the zirconium and titanium with the aid of the free acids and to adjust the respective pH-value as necessary by the addition of ammonia.

The pickling of the work pieces (method stage a)) takes place with an aqueous, acidic solution containing a mineral acid. It can take place electrolytically or chemically. In the case of electrolytic pickling, phosphoric acid is particularly suitable as the mineral acid. The pickling by chemical means, to which, as a rule, preference is given because the method is less costly in terms of apparatus, can be carried out with nitric acid or nitric acid/hydrofluoric acid. In accordance with a preferred development of the invention, the work pieces are pickled by spraying with or immersion in a solution which contains surfactant, hydrofluoric acid and sulphuric acid, with solutions which contain 3 to 8 g/l sulphuric acid, 50 to 150 mg/l non-complexed, free fluoride and 1 to 3 g/l non-ionogenic surfactant proving particularly suitable. Ethylene oxide adducts on fatty alcohols and, for example, abietic acid are particularly suitable as non-ionic surfactants.

The measurement of the free fluoride was carried out with a fluoride-sensitive electrode, the calibration of the electrode being carried out with solutions, the pH-value of which was identical to that of the solution to be tested.

In order that layers having an optimal volume resistance are achieved in the subsequent treatment in accordance with stage c), the pickling method is to be carried out in such a way that a metal removal of approximately 0.1 to 0.6 g/m$^2$ work-piece surface is obtained.

The rinsing with water—in accordance with stage b)—that follows the pickling of the work pieces preferably takes place in a plurality of rinsing stages, it being particularly advantageous to direct the rinsing water against the work piece in a cascading manner. In this case, the last rinsing stage is to be carried out with deionized water. As a result of the treatment in accordance with stage c) that follows the pickling stage and rinsing stage, a renewed growth of an oxide layer on the work pieces having a surface made of aluminium or aluminium alloy is prevented from occurring.

A further advantageous embodiment of the invention provides bringing the work pieces in stage c) into contact with a solution containing a colloidal silicic acid. As a result of the content of silicic acid in the solution, the varnish adhesion in the case of a subsequent varnishing is improved. A disadvantageous influencing of the volume resistance does not take place. A particularly suitable silicic acid is pyrogenic silicic acid with an average particle size of 10 to 25 nm. Particularly advantageous layer weights are between 2 and 30 mg/m$^2$ (calculated as Si). On the basis of these particulars, the silicic-acid concentrations to be set in the treatment solutions used in each case in stage c) are to be established in a simple way with the aid of a few tests. In the case of application of the solution by the roll-coater method, they can easily be calculated by way of the wet-film amount to be applied.

In the case of a subsequent treatment by non-cutting shaping that follows stage c), a further advantageous embodiment of the invention provides applying a lubricant to the work pieces. These are, in particular, mineral-oil-based forming oils which can be fully synthetic or natural, or polyethylene/polyacrylate-based dry lubricants.

As a rule, it is appropriate to insert cleaning stages and water-rinsing stages before the permanent corrosion-preventing treatment. If a primer application or varnish application is provided, a previous drying is recommended. If a chromium-free conversion treatment is to follow, it is possible in the case of application by immersion or spraying also to work wet to wet, i.e. without previous drying. In the case of application in accordance with the roll-coater method, an intermediate drying is essential. For the case of a subsequent phosphating treatment, which can also take place wet to wet, it is advantageous to provide an activating treatment, for example with an activating agent containing titanium and phosphate.

With the aid of the method in accordance with the invention, work pieces are regularly obtained with layers which allow a perfect shaping and/or gluing or, as a result of the low electrical volume resistance which is uniform over the work-piece surface, allow a perfect and problem-free welding. Furthermore, the work pieces are best suited for a subsequent permanent corrosion-preventing treatment.

The invention is explained in greater detail with the aid of the following examples:

EXAMPLES

With the exception of a sheet-metal batch which was cleaned in an alkaline environment (Example 1), sheets made of aluminium alloys of the quality AA 6016 and AA 5182 were first pickled in a degreasing manner at a temperature of 50° C. by immersion or spraying. The pickling solution contained 6 g/l sulphuric acid (100%) 100 mg/l hydrofluoric acid (100%) 2 g/l non-ionic surfactant, consisting of ethoxylated fatty alcohol and ethoxylated abietic acid in the weight ratio 1:1.

The pickling method was carried out in such a way that the pickling removal amounted to 0.3 to 0.4 g/m$^2$ in the case of the alloy AA 5182, and 0.2 to 0.3 g/m$^2$ in the case of the alloy AA 6016. For this purpose, treatment times of between 5 and 20 seconds were required.

Following this, the work pieces were rinsed thoroughly with water, in the last stage with deionized water. The volume resistances measured on the individual sheet were 6 to 8 $\mu$-Ohm in the case of the alloy AA 5182, and 9 to 11 $\mu$-Ohm in the case of the alloy AA 6016.

After this, there was a treatment with solutions of the hexafluoric acids of titanium and/or zirconium, the data for which with respect to the concentration of titanium and/or zirconium, the pH-value and the type of application are reproduced in Table 1. Where necessary, the adjustment of the pH-value took place with ammonia solution.

TABLE 1

| | Concentration in mg/l | | | | | pH- | |
|---|---|---|---|---|---|---|---|
| Example | Ti | Zr | $TiF_6$ | $ZrF_6$ | $TiF_6$+$ZrF_6$ | value | application |
| 1 | 354 | 360 | 1197 | 810 | 2007 | 2.4 | immersion |
| 2 | 354 | 360 | 1197 | 810 | 2007 | 2.4 | immersion |
| 3 | 362 | 1074 | 1224 | 2416 | 3640 | 1.9 | roll-coater |
| 4 | 1075 | 360 | 3634 | 810 | 4444 | 1.8 | roll-coater |
| 5 | 700 | 0 | 2367 | 0 | 2367 | 2 | immersion |
| 6 | 60 | 60 | 203 | 135 | 338 | 4.2 | spraying |
| 7 | 120 | 120 | 406 | 270 | 676 | 4.1 | immersion |
| 8 | 1328 | 1328 | 4490 | 2987 | 7477 | 2 | roll-coater |
| 9 | 60 | 60 | 203 | 135 | 338 | 4.2 | immersion |
| 10 | 0 | 40 | 0 | 90 | 90 | 4.2 | immersion |
| 11 | 60 | 60 | 203 | 135 | 338 | 4.2 | immersion |
| 12 | 60 | 60 | 203 | 135 | 338 | 4.2 | immersion |
| 13 | 2700 | 2600 | 9128 | 5849 | 14977 | 1.8 | roll-coater |

The application of the solutions, which were at room temperature, took place by immersion or in accordance with the roll-coater method, the immersion duration or wet-film thickness being chosen in such a way that the layer weights (calculated as titanium metal or zirconium metal) mentioned in column 2 of Table 2 resulted. In the case of the application by immersion or spraying, excess treatment solution was removed with squeegee rollers, and the treated surface was subsequently dried. The drying, or the drying-off in the case of the roll-coater application, took place at 60° C. in each case.

TABLE 2

| | Layer (mg/m$^2$) | | | | Volume resistance | | | | Adhesion shear-tension values (N/mm$^2$) | | | |
|---|---|---|---|---|---|---|---|---|---|---|---|---|
| Example | 6016 Ti | 5182 Ti | 6016 Zr | 5182 Zr | 6016 immediate | 5182 immediate | 6016 after 30 days | 5182 after 30 days | 6016 start | 5182 start | 6016 20 Rdn | 5182 20 Rdn SCAB |
| 1 | 10 | | 10 | | 114 | | 147 | | 12.6 | | 11.2 | |
| 2 | 10 | | 10 | | 30 | | 92 | | | | 12.2 | |
| 3 | 3 | | 8 | | 21 | | 52 | | 13.1 | | 11.4 | |
| 4 | 8 | | 3 | | 49 | | 80 | | 12.8 | | 11.2 | |
| 5 | 10 | | | | 40 | | 68 | | 13.3 | | 11.0 | |

TABLE 2-continued

| | Layer (mg/m²) | | | | Volume resistance | | | | Adhesion shear-tension values (N/mm²) | | | |
|---|---|---|---|---|---|---|---|---|---|---|---|---|
| Example | 6016 Ti | 5182 Ti | 6016 Zr | 5182 Zr | 6016 immediate | 5182 immediate | 6016 after 30 days | 5182 after 30 days | 6016 start | 5182 | 6016 20 Rdn | 5182 SCAB |
| 6 | 2 | | 2 | | 4 | | 8 | | 14.2 | | 13.0 | |
| 7 | 6 | | 6 | | 22 | | 23 | | 13.3 | | 12.4 | |
| 8 | 4 | | 4 | | 12 | | 20 | | 13.5 | | 13.0 | |
| 9 | 6 | 7 | 4 | 5 | 18 | 10 | 31 | 34 | 15.8 | | 16.8 | 11.5 |
| 10 | | | 8 | 8 | 26 | 38 | 45 | 95 | 16.4 | | 17.4 | 12.1 |
| 11 | 5 | 4 | 3 | 4 | 11 | 9 | 27 | 36 | 15.7 | | 16.8 | 11.8 |
| 12 | 4 | 4 | 4 | 4 | 10 | 18 | 24 | 35 | 15.3 | 16.7 | 15.3 | 14.7 |
| 13 | 4 | 4 | 4 | 4 | 21 | | 30 | | 17.8 | | 16.7 | |

In columns 3 and 4 of Table 2, the volume resistances obtained in the case of the individual sheet measurements are given in $\mu$-Ohm and the adhesion shear-tension values are given in N/mm$^2$. The measurement of the volume resistances was carried out immediately after the drying/drying-off (first row "immediate") and after a storage of 30 days (second row "after 30 days"). It took place in accordance with DVS data sheet 2929 with copper electrodes 20 mm in diameter. The adhesion shear-tension values were established with shear-tension tests in accordance with DIN 53283 with the aid of a commercially available two-component epoxy adhesive. The first row of column 4 of Table 2 gives the measured values which were obtained immediately after the gluing; the second row gives the measured values which were obtained after 30 days of salt-spray condensation-water alternating test in accordance with VDA 621-415.

The following can be deduced from the measured values of Table 2. The treatment of the aluminium sheets with an alkaline cleaner that was carried out in Example 1 in order to prove the necessity of an acidic pickling solution in stage a) leads to sheets which admittedly have good adhesion shear-tension values, but which have extremely poor volume resistance values.

Example 2 shows that as a result of an excessively high layer weight of the layer obtained in the case of the treatment in accordance with stage c), very high volume resistances—in particular after a storage of 30 days—are obtained.

In Examples 3 to 5 and 10, the layer weights which are obtained are admittedly within the desired range, but as a result of the titanium/zirconium ratio in the treatment solution for the method step c) of approximately 1:3 (Example 3) or approximately 3:1 (Example 4) or as a result of the absence of zirconium (Example 5) or as a result of the absence of titanium (Example 10) in the solution, the volume resistance values obtained, in particular after 30 days' storage, are not acceptable.

By contrast, Examples 6 to 9 and 11 to 13 show that when the conditions with respect to the type of pickling treatment, the Ti/Zr ratio, the layer weight which is generated, the respective concentration and pH ranges of the treatment solutions that are essential to the invention are met, layers with extremely good volume resistances and simultaneously good adhesive properties are obtained.

The results of the corrosion protection were good in all cases.

What is claimed is:

1. A method for the pretreatment of a workpiece having a surface of aluminum or aluminum alloy comprising:

a) pickling the workpiece, said workpiece having a surface of aluminum or aluminum alloy, by contacting the workpiece with an aqueous, acidic pickling solution comprising a mineral acid by immersion or spraying, b) rinsing the pickled workpiece with water, c) bringing the rinsed workpiece into contact with an aqueous acidic pretreatment solution which is chromium-free and polymer-free and consists essentially of Ti and Zr as complex fluorides in a ratio of Ti:Zr of 2:1 to 1:2 and optionally colloidal silicic acid, such that after subsequent drying a coating weight of 2 to 15 mg/m$^2$ determined as Ti/Zr metal results, wherein when said workpiece is brought into contact with said pretreatment solution by immersion or spray application, said pretreatment solution contains 300 to 700 mg/l of fluoride determined as fluoro anion and has a pH of 4.0 to 5.0, and when said workpiece is brought into contact with said pretreatment solution by a rolling-on method, said pretreatment solution contains 5000 to 15000 mg/l of fluoride determined as fluoro anion and a pH value of 1.0 to 3.0; and subsequently treating said dried workpiece with a permanent corrosion-preventing treatment.

2. A method according to claim 1, wherein said workpiece is pickled with a solution containing a surfactant, hydrofluoric aid and sulfuric acid.

3. A method according to claim 2, wherein said workpiece is pickled with a solution which contains 3 to 8 g/l of sulfuric acid, 50 to 150 mg/l of free fluoride and 1 to 3 g/l of nonionic surfactant.

4. A method according to claim 1, wherein, said workpiece was subjected to a non-cutting shaping process prior to the pretreatment, and a lubricant was applied before that non-cutting shaping process.

5. A method according to claim 1, wherein cleaning, rinsing and, optionally activation treatments are performed before the permanent corrosion-preventing treatment.

6. A method for the pretreatment of a workpiece having at least one surface of aluminum or aluminum alloy and at least one surface of steel, zinc-coated steel, zinc-alloy coated steel, comprising:

a) pickling the workpiece, said workpiece having at least one surface of aluminum or aluminum alloy and at least one surface of steel, zinc-coated steel, zinc-alloy coated steel, by contacting the workpiece with an aqueous, acidic pickling solution comprising a mineral acid by immersion or spraying, b) rinsing the pickled workpiece with water, c) bringing the rinsed workpiece into contact with an aqueous acidic pretreatment solution which is chromium-free and polymer-free and consists essentially of Ti and Zr as complex fluorides in a ratio of Ti:Zr of 2:1 to 1:2 and optionally colloidal silicic acid, such that after subsequent drying a coating weight of 2 to 15 mg/m$^2$ determined as Ti/Zr metal results, wherein when said workpiece is brought into contact with said pretreatment solution by immersion or spray application, said pretreatment solution contains 300 to 700 mg/l of fluoride determined as fluoro anion and has a pH of 4.0 to 5.0, and when said workpiece is brought into contact with said pretreatment solution by a rolling-on method, said pretreatment solution contains 5000 to 15000 mg/l of fluoride determined as fluoro anion and a pH value of 1.0 to 3.0; and subsequently treating said dried workpiece with a permanent corrosion-preventing treatment.

7. A method according to claim 6, wherein said workpiece is pickled with a solution containing a surfactant, hydrofluoric acid and sulfuric acid.

8. A method according to claim 6, wherein said workpiece is pickled with a solution which contains 3 to 8 g/l of sulfuric acid, 50 to 150 mg/l of free fluoride and 1 to 3 g/l of nonionic surfactant.

9. A method according to claim 6, wherein said workpiece was subjected to a non-cutting shaping process prior to the pretreatment, and a lubricant was applied before that non-cutting shaping process.

10. A method according to claim 1, wherein cleaning, rinsing and, optionally activation treatments are performed before the permanent corrosion-preventing treatment.

* * * * *